US005218412A

United States Patent [19]

Martin

[11] Patent Number: 5,218,412

[45] Date of Patent: Jun. 8, 1993

[54] 180 DEGREE ROTATING CLEANING BLADE HOLDER

[75] Inventor: Crystal A. Martin, Rochester, N.Y.

[73] Assignee: Xerox Corporation, Stamford, Conn.

[21] Appl. No.: 944,617

[22] Filed: Sep. 14, 1992

Related U.S. Application Data

[63] Continuation of Ser. No. 803,937, Dec. 9, 1991, abandoned.

[51] Int. Cl.[5] ..... G03G 21/00

[52] U.S. Cl. ..... 355/299; 15/256.5; 198/497

[58] Field of Search ..... 355/296, 297, 299; 15/256.5; 198/497, 498

[56] References Cited

U.S. PATENT DOCUMENTS

| | | | |
|---|---|---|---|
| 3,847,480 | 11/1974 | Fisher | 355/299 |
| 3,913,728 | 10/1975 | Pott | 198/498 |
| 4,202,437 | 5/1980 | Gordon | 198/497 |
| 4,311,094 | 1/1982 | Ellison | 101/425 |
| 4,328,888 | 5/1982 | Luke | 198/499 |
| 4,359,150 | 11/1982 | Bowman et al. | 15/256.5 |
| 4,694,952 | 9/1987 | Meijer | 15/256.5 |
| 4,768,644 | 9/1988 | Cromm | 15/256.5 |
| 4,768,645 | 9/1988 | Farris | 15/256.5 |
| 4,779,119 | 10/1988 | Kaieda | 15/256.5 |
| 4,779,716 | 10/1988 | Gordon | 15/256.5 |
| 4,787,500 | 11/1988 | Holz | 15/256.5 |
| 4,825,996 | 5/1989 | Davidts | 15/256.5 |
| 4,827,311 | 5/1989 | Bothner et al. | 15/256.5 |
| 4,840,267 | 6/1989 | Pine | 15/256.5 |
| 4,917,231 | 4/1990 | Swinderman | 198/497 |
| 4,927,003 | 5/1990 | Swinderman et al. | 15/256.5 |
| 4,944,386 | 7/1990 | Swinderman | 15/256.5 |
| 4,953,689 | 9/1990 | Peterson et al. | 198/497 |
| 5,007,523 | 4/1991 | Morefield | 198/497 |
| 5,011,002 | 4/1991 | Gibbs | 198/497 |
| 5,081,505 | 1/1992 | Ziegelmuller | 15/256.5 |

*Primary Examiner*—R. L. Moses

*Attorney, Agent, or Firm*—Tamera L. Fair

[57] ABSTRACT

A cleaning blade holder that has a top and bottom portion. The bottom portion of the blade holder contains a groove into which a protruding rib from the back side surface of the blade fits in order to dummy proof the orientation of the blade and to secure the fit. An alternative bottom portion contains a plurality of nodules along the bottom portion surface that interconnect with apertures in corresponding positions to the nubbins along the length of the blade body. The blade holder holds the blade body in a horizontal position allowing the edges on either side of the blade body to extend from the holder. Each side of the blade body fosters two edges. Rotation of the blade holder produces a new cleaning edge. Two other cleaning edges are produced by reversing the blade body in the holder and rotating the blade holder again between positions one and two.

6 Claims, 3 Drawing Sheets

180 DEGREE ROTATING CLEANING BLADE HOLDER

This is a continuation of application Ser. No. 803,937, filed Dec. 9, 1991, now abondoned.

BACKGROUND OF THE INVENTION

This invention relates generally to electrophotographic printing, and more particularly, a cleaning blade used therein to remove particles adhering to the photoconductive member.

In the process of electrophotographic printing, a photoconductive surface is charged to a substantially uniform potential. The photoconductive surface is imagewise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a sheet of support material and permanently affixed thereto.

This process is well known and useful for light lens copying from an original and printing applications from electronically generated or stored originals, and in ionography.

In a reproduction process of the type as described above, it is inevitable that some residual toner will remain on the imaging (i.e. photoreceptive, photoconductive) surface after the toner image has been transferred to the sheet of support material (e.g. paper). It has been found that with such a process that the forces holding some of the toner particles to the imaging surface are stronger than the transfer forces and, therefore, some of the particles remain on the surface after transfer of the toner image. In addition to the residual toner, other particles, such as paper debris (i.e. Kaolin, fibers, clay), additives and plastic, are left behind on the surface after image transfer. (Hereinafter, the term "residual particles" encompasses residual toner and other residual particles remaining after image transfer.) The residual particles adhere firmly to the surface and must be removed prior to the next printing cycle to avoid its interfering with recording a new latent image thereon.

Various methods and apparatus may be used for removing residual particles from the photoconductive imaging surface. Hereinbefore, a cleaning brush, a cleaning web, and a cleaning blade have been used. Both cleaning brushes and cleaning webs operate by wiping the surface so as to affect transfer of the residual particles from the imaging surface thereon. After prolonged usage, however, both of these types of cleaning devices become contaminated with toner and must be replaced. This requires discarding the dirty cleaning devices. In high-speed machines this practice has proven not only to be wasteful but also expensive.

The shortcomings of the brush and web made way for another now prevalent form of cleaning known and disclosed in the art—blade cleaning. Blade cleaning involves a blade, normally made of a rubberlike material (i.e. polyurethane) which is dragged or wiped across the surface to remove the residual particles from the surface. Blade cleaning is a highly desirable method, compared to other methods, for removing residual particles due to its simple, inexpensive structure. However, there are certain deficiencies in blade cleaning which are primarily a result of the frictional sealing contact that must occur between the blade and the surface. This frictional sealing contact often leads to blade failure and as a result requires blade replacement.

To change a cleaning blade in a conventional xerographic copier a customer service engineer (CSE), technical representative or the like, must, for every blade change, perform sometimes as many as a 24 step process that includes completely removing the photoreceptor belt module.

The present process for installing the cleaning blade (average size of the cleaning blade is about a 37 cm × 1.8 cm × 0.2 cm urethane slab) in its present holder requires the CSE to push the blade into the holder channel until the blade reaches maximum penetration (about 1.1 cm) along the entire length of the blade. This is not a simple operation. The blade uses a friction fit to hold the blade in position inside its holder. The blade's snug fit causes it to stick to the sides of the holder and resist being pressed into the channel. Since the blade is pliable, the blade bends as the CSE tries to push it into its proper position, making the job difficult.

It requires a lot of practice to be able to accomplish the task of installing a new blade in this manner. Even after the blade is finally inserted into the holder channel, it is not obvious whether or not the blade is properly aligned for an even cleaning edge. Although cleaning blades have been able to clean when installed slightly skewed, a skewed blade can also cause photoreceptor tracking problems. These tracking problems can cause premature failure of the photoreceptor and other failures. A skewed cleaning blade also wears unevenly and causes premature failure of the blade also. It is an object of the present invention to provide an easier means for inserting the blade so that skewing of the blade does not occur.

The following disclosures may be relevant to various aspects of the present invention and may be briefly summarized as follows:

U.S. Pat. No. 4,202,437 to Gordon discloses a conveyor belt scraper assembly to remove foreign matter from a conveyor belt. This design allows rapid and efficient replacement of worn out blades. The scraper assembly is mounted on a pair of slide housings which allows adjustment of the angular orientation of the blade to compensate for substantial wear on the scraper edge. A scraper core holds three blades, all 120 degrees apart which may be used substitutively when one blade wears out. The blades consist of two working edge surfaces so that when one surface is diminished and unusable, the mounting can be reversed to provide a new working surface.

U.S. Pat. No. 4,311,094 to Ellison discloses a method and apparatus for removing foreign matter from a printing plate mounted on a cylinder. A pair of parallel, spaced flexible blades contact the surface of the plate whereby one blade spreads and thins ink on a surface while the other blade dislodges and removes them from the surface. The blades are supported by a mounting member which extends across the entire width of the printing plate and is parallel to the axis of the plate cylinder.

U.S. Pat. No. 4,328,888 to Luke discloses a conveyor belt scraper blade in which one longitudinal axis makes contact with a conveyor belt surface to be scraped. The blade extends in opposite lateral directions beyond the periphery of a metallic reinforcing strip to provide two scraper edges. The hard rubber blade, bonded to a metallic reinforcing strip, makes contact with the conveyor belt and scrapes foreign matter therefrom. After wearing of one edge of the blade, the worn blade may be released from the supporting arrangement and reversed to present its' other edge to the belt surface.

SUMMARY OF INVENTION

Briefly stated, and in accordance with one aspect of the present invention, there is provided an apparatus for cleaning particles from an imaging surface. The apparatus has means for cleaning particles from the imaging surface where the cleaning means has at least two surfaces. The apparatus also has means for holding the cleaning means where the holding means is movable to position one of the surfaces in contact with imaging surface, with the other of the surfaces being remote therefrom.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 1:
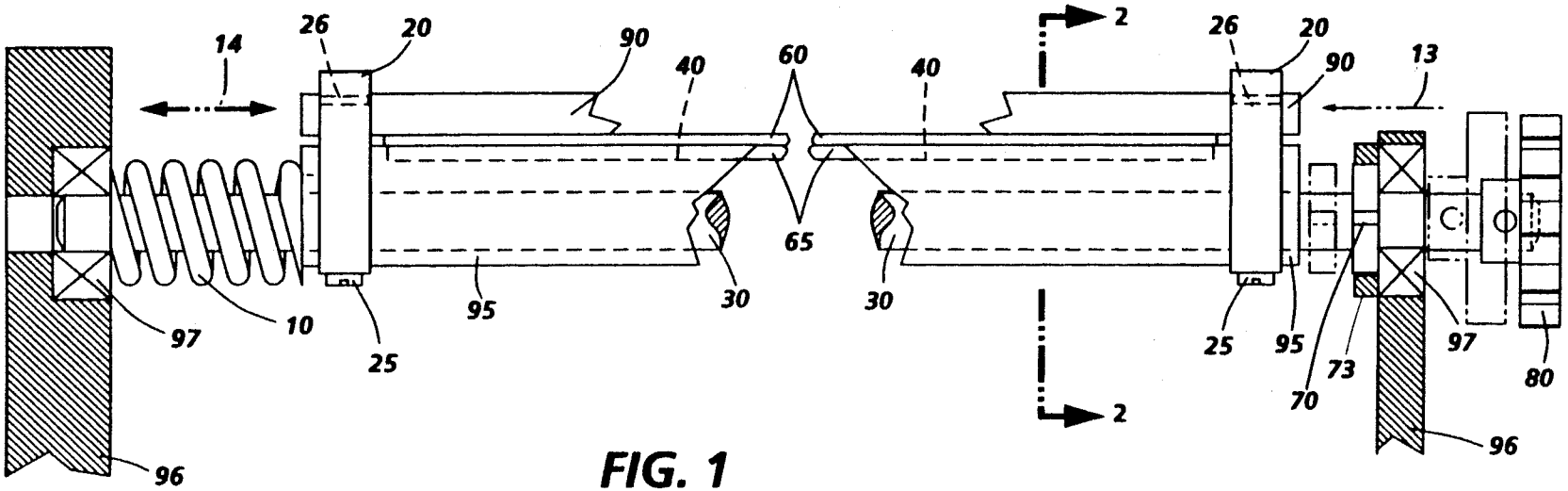
FIG. 1 is a schematic elevational view of a rotatable blade holder.

Referring now to FIG. 1 which shows a rotatable blade holder having a top component 90 and a bottom component 95 held together on each end by a spring clip or clamp 20. The bottom component 95 has a channel through which a shaft 30 is inserted. The shaft 30 extends through the channel in the base of the bottom component 95 into a bearing 97, on each end of the shaft 30, that anchor the blade holder in the machine frame 96. A spring 10 is helically wound about one end of the shaft 30 between the bearing 97 and the side edge of the bottom component 95 of the blade holder. The spring 10 expands and contracts in the directions indicated by the arrow 14. The end of the shaft 30, opposite the shaft 30 end with the helically wound spring 10, terminates in a knob 80. The knob 80 is used to rotate the entire blade holder to the desired position to place a cleaning edge of the blade body 60 in line contact with the imaging surface in order to clean the surface of residual debris. The knob 80 is pressed forward, in the direction indicated by arrow 13, after which the blade holder is rotated 180 degrees to bring another cleaning edge in contact with the imaging surface. As the knob 80 is pressed forward, the spring 10 contracts and the key 70 also moves forward in the direction of arrow 13. FIG. 1 depicts, via phantom lines, the forward movement of the key 70 and the knob 80 when pressed in for rotation. When the knob 80 rotates the blade holder to the desired blade cleaning position, the knob 80 is released allowing the spring 10 to expand to it's initial position thus, moving the key 70 and the knob 80 back to their original positions. There are slots in the key block 73 that allow the key 70 to lock into position upon each rotation of 180 degrees or whatever is the desired locking position.

The upper portion of the bottom component 95 of the blade holder, located above the shaft 30 channel, has a trough or indentation 40 in which the blade rib 65 fits. The rib 65 is inserted into the trough 40 to guide the blade body 60 into proper alignment within the blade holder. The blade holder top component 95, in the figure, lies along the longitudinal center line of the top surface of the blade body 60. The top component 90 and the bottom component 95 of the blade holder are fastened together by a spring clamp or clip 20 on either end of the blade holder assembly to hold the blade body 60 in place.

Figure 2:
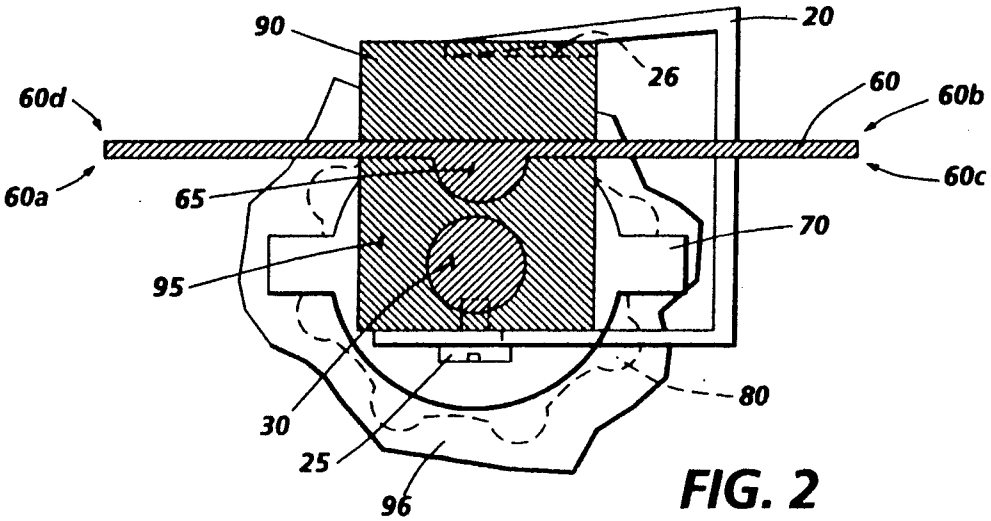
FIG. 2 is a sectional view of the blade holder containing a ribbed blade body.

Referring now to FIG. 2 which shows a sectional view of the blade holder in FIG. 1. The spring clamp 20 has a pressure fit to hold the blade holder components 90, 95 together firmly. The top component 90 of the blade holder has a groove 26 into which the top end of the spring clamp 20 is slidably inserted. The bottom end of the spring clamp 20 has a pronged shape that forms a pressure fit around the neck of the screw 25 that extends from the base of the bottom component 95 of the blade holder. The screw 25 extends far enough from the base of the bottom component 95 of the blade holder, to allow the pronged end of the spring clamp 20 to fit between the head of the screw 25 and the base of the blade holder bottom 95. The end opposite the head of the screw 25, terminates in the shaft 30 enabling a secure hold between the shaft 30 and the bottom component 95 of the blade holder.

To rotate a cleaning blade installed in the blade holder to a new edge is a simple task. When copy quality is a problem and the cleaning blade is the suspected culprit, the customer can be directed to rotate the blade.

With continued reference to FIG. 2, the blade body 60 has a total of four cleaning edges **60*a*, 60*b*, 60*c*, 60*d* that extend laterally outside of the blade holder assembly. When the blade holder assembly is in it's initial cleaning position (1), the cleaning edge 60*a* is in line contact with the photoreceptive surface (shown in FIG. 4). When the blade edge 60*a* requires replacing, the blade holder assembly is rotated 180 degrees to second position (2). The second cleaning edge 60*b*** is then placed in line contact with the photoreceptive surface (i.e. imaging or photoconductive).

The stationary blade holder makes replacement of the blade body 60 (when it is no longer useable on the first two cleaning edges **60*a*, 60*b*) much easier. Although blade replacement requires removal of the photoreceptor, the replacement task is simplified because: a) the top component 90 of the blade holder can be totally separated from its bottom component 95 allowing a new blade edge 60***d* to be easily pressed into position. When another new cleaning blade edge is required, the spring clamps 20 are unfastened to allow separation of the top component 90. The blade body 60 is removed, reversed and then reinserted in the blade holder using the rib 65 for proper alignment of the blade edges. After reassembling the blade holder assembly, the blade holder assembly is rotated 180 degrees back to position (1), and a third new cleaning edge 60*d* is in line contact with the photoreceptive surface to clean the photoreceptive surface. Rotating the blade assembly 180 degrees to position 2, prepares the fourth cleaning edge 60*c* for cleaning of the photoreceptive surface. The blade body 60 and the blade holder are designed with a mating rib 65 and groove 40 (see FIG. 1) to aid proper blade alignment. The order of use of the cleaning edges 60*a*, 60*b*, 60*c*, 60*d* and rotation between the two positions of the blade holder for cleaning can be varied.

Figure 3:
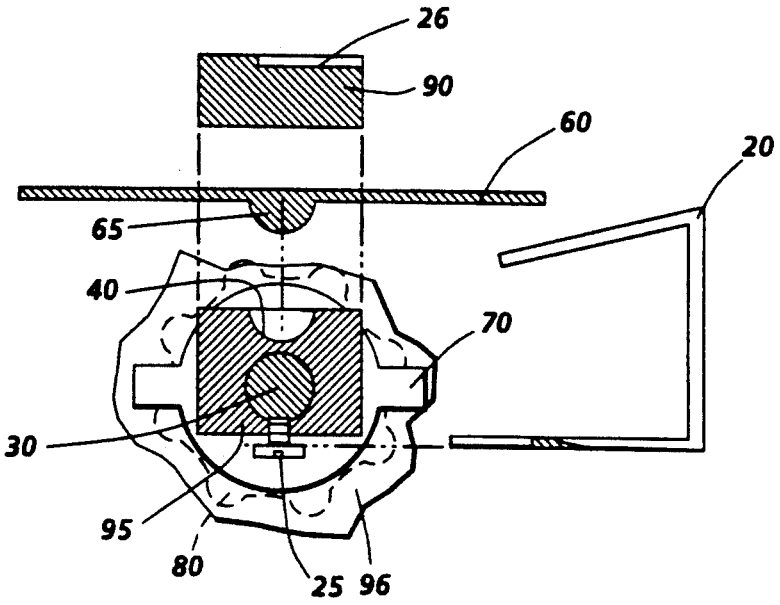
FIG. 3 is a schematic view illustrating the separate components of the blade holder.

Referring now to FIG. 3 which shows the blade holder and it's separate components. The top component 90 of the blade holder is detachable from the remainder of the blade holder assembly when the spring clips 20 are removed. A groove 26 exists on each end of the top surface of the top component 90 for the top part of a spring clip 20 to be slidably inserted. A screw 25 extends from the base of the blade holder, to secure the bottom part of the spring clip 20. The blade body 60 lies horizontally between the top component 90 and the bottom component 95 of the blade holder. The blade body 60 is aligned in the blade holder by insertion of the rib 65, that extends lengthwise down the centerline of the blade body 60, into the trough 40 in the bottom component 95 of the blade holder. (The rib 65 can be molded or bonded to the bottom surface of the blade body.). The trough 40 extends the length of the blade body 60 down the center line of the bottom component 95 of the blade holder. The shaft 30 runs through a channel under the trough 40 in the blade holder's bottom component 95. Also shown in FIG. 3 is the key 70 that locks the blade holder in place after rotation, the knob 80 in phantom lines, for rotating the blade holder, and the machine frame 96.

Figure 4:
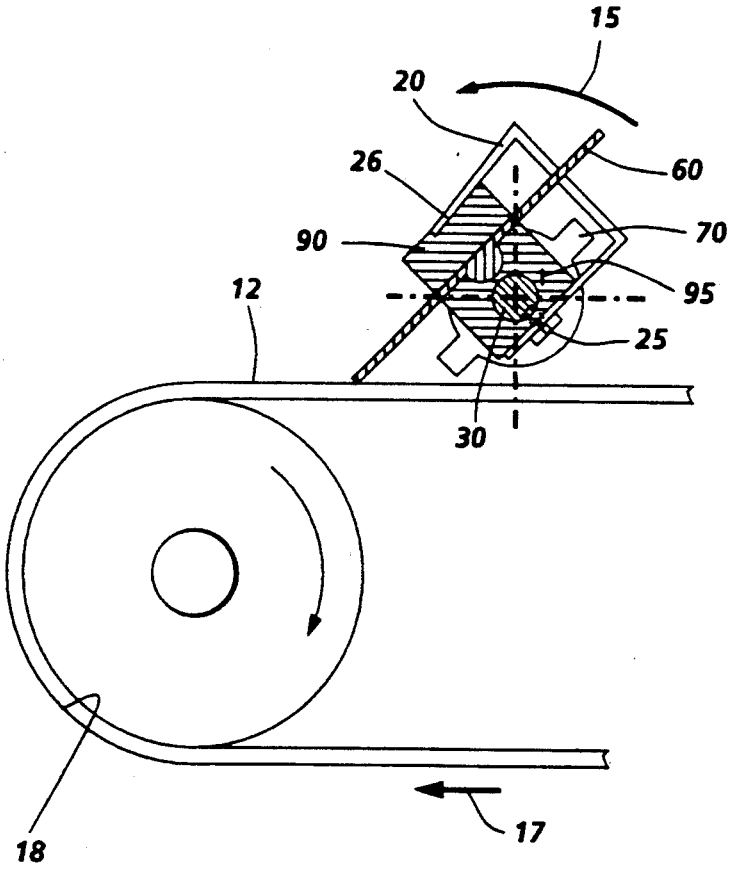
FIG. 4 is a schematic elevational view illustrating the orientation of the blade holder and the blade angle in operation.

Referring now to FIG. 4 which shows the orientation of the blade holder and the blade angle when the copier is in operation. The cleaning blade edge 60*a*, 60*b*, 60*c*, 60*d* (not shown) has an angle of 15 to 25 degrees when the copier is in operation. FIG. 4 shows one of the four cleaning edges 60*a*, 60*b*, 60*c*, 60*d* in line contact with the photoreceptive surface 12. The arrow 15 indicates the direction of rotation of the blade holder. The blade body 60 has two cleaning edges 60*a*, 60*b*, 60*c*, or 60*d* on each side of the blade body 60 ends protruding from the blade holder. The photoreceptor belt 18, as shown, moves in the direction of arrow 17. The figure shows the cleaning blade edge operating in the doctoring mode. However, the cleaning blade edge can operate in either the wiping or doctoring mode.

Figure 5:
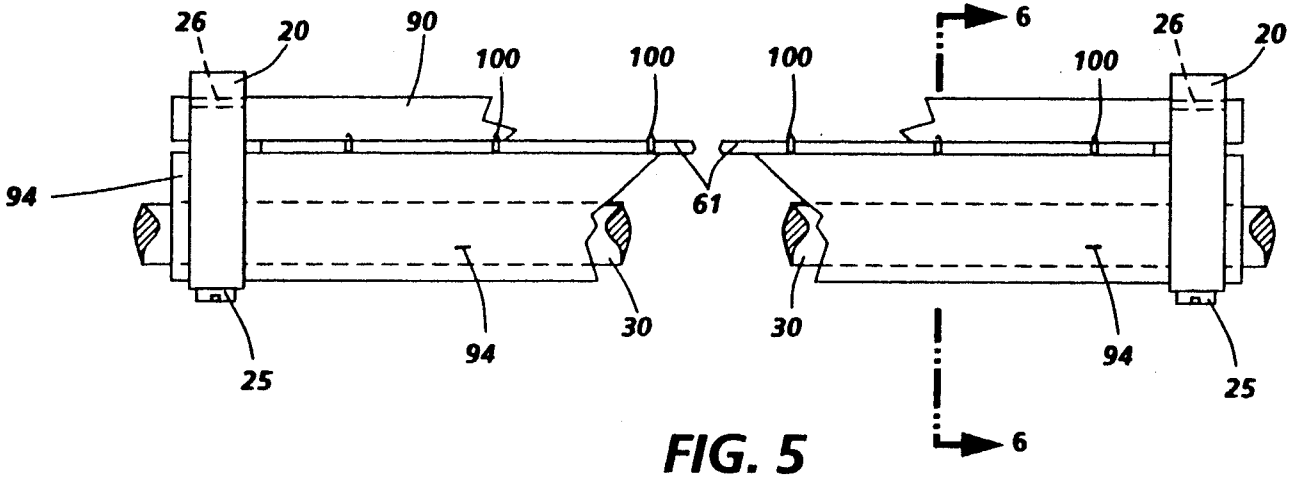
FIG. 5 is a schematic of the blade holder with an alternate blade body configuration.
Figure 6:
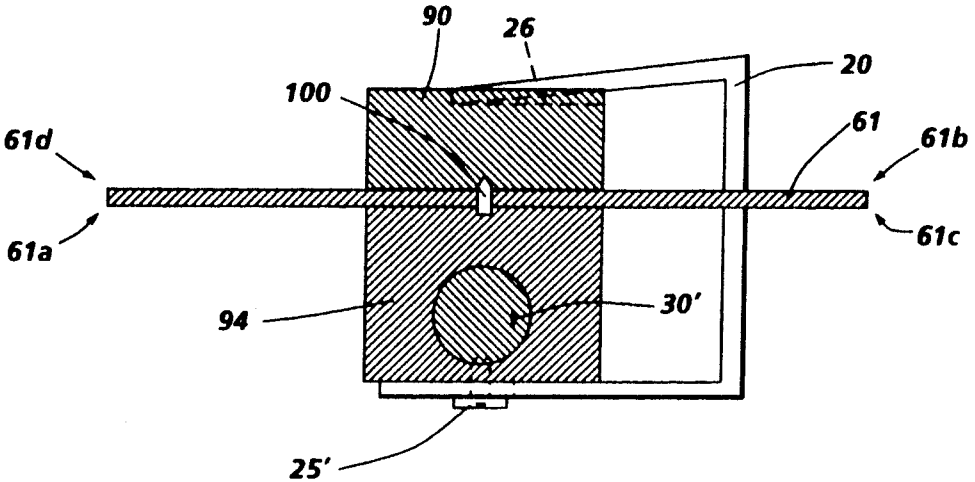
FIG. 6 is a sectional view of the alternate blade body configuration of FIG. 5.

Referring now to FIG. 5 which shows a blade holder with an alternate blade body configuration. This figure shows a blade body 61 that has a series of apertures or holes through which nodules or nubbins 100 are inserted. The nodules 100 are located on the top surface of the bottom component 94 of the blade holder and extend upward through the coinciding holes in the blade body 61. The ends of these nodules 100 terminate in their mating indentations on the bottom surface of the top component 90 of the blade holder. The blade holder assembly and operation of FIG. 1 is also applicable to this figure providing some adjustments are made for the alternate blade body 61. This figure's blade body 61 utilizes nodules 100 and apertures instead of a rib 65 (shown in FIG. 1) to align the blade edge and secure the blade body 61 into the blade holder assembly. However, the blade body 61 of FIG. 5, still provides four cleaning edges 61*a*, 61*b*, 61*c*, 61*d* as shown in FIG. 6. These four cleaning edges achieve line contact with the photoreceptive surface in the same manner as the cleaning edges 60*a*, 60*b*, 60*c* 60*d* of the ribbed blade body 60 described FIG. 4.

Referring now to FIG. 6 which shows a sectional view of the blade holder assembly in FIG. 5. The top component 90 of the blade holder has a groove 26 into which the top end of the spring clamp 20 is slidably inserted. The ends of the nodules 100 are received by the mating indentations of the top component 90 of the blade holder. The blade body 61 is held in place by a series of nodules 100 inserted through apertures or holes in the blade body 61. The blade body 61 has four cleaning edges 61*a*, 61*b*, 61*c* and 61*d*. The bottom end of the spring clamp 20 has a pronged shape that forms a pressure fit around the neck of the screw 25 that extends from the base of the bottom component 95 of the blade holder. The screw 25 extends far enough from the base of the bottom component 94 of the blade holder, to allow the pronged end of the spring clamp 20 to fit between the head of the screw 25 and the base of the blade holder bottom component 94. The end of the screw 25 opposite the head, terminates in the shaft 30 to securely hold, the shaft 30 in the bottom component 94 of the blade holder.

A misaligned blade is not an uncommon problem. Out of a small population of randomly chosen used blades, 14% had a magnetite stain that indicated skewed wear. This wear pattern can be caused by the photoreceptor not racking properly or the cleaning blade not being installed properly. Since it is much easier to misalign the blade than the photoreceptor it can safely be assumed that most of these blades were not correctly installed.

After the CSE has loaded the blade into its holder, the holder must be clipped (at two locations) onto cleaning assembly brackets inside the machine. Another easy error for the CSE to make is to clip only one side of the holder into position. At a quick glance the holder will appear to be properly installed. This error has also been observed in operating copiers, but it should be noted that this error causes the same problems cited earlier pertaining to skewed blades.

To decrease the service time needed to change the cleaning blade to less than one minute and to reduce the steps required to accomplish this task from a 24 step process to a six step process, the present invention of a 180 degree rotating cleaning blade holder is installed. This blade holder includes a stationary holder and an improved blade design that has four cleaning edges (see FIGS. 1 through 6). By using this holder, the cleaning blade potentially has double the life of a conventional blade before the blade actually needs to be replaced.

One known form of blade failure is entrapment of a particle, causing a streak on the photoreceptor. It has been noted that a particle trapped on the surface of a photoreceptor can sometimes be released by moving the cleaning blade away from the photoreceptor then returning it to its working position. When a streak failure is observed, the customer or CSE could easily cam back the cleaning blade, rotate the holder, then test to see if the failure persists.

For the cleaning blade to seal against the photoreceptor surface and insure proper cleaning, the blade holder must be sufficiently rigid to prevent bowing. It is recommended that rigidity calculations be performed and an appropriate material be selected for the new holder so that it will provide a uniform blade load across the photoreceptor.

The typical blade material for cleaning blades is polyurethane. The common fabrication of polyurethane cleaning blades is through the use of a centrifuge. For purposes of this invention, it is preferred that the cleaning blade be made without the use of mold release because mold release reduces the reliability of the "mold side" of the cleaning blade. However, if the blade is fabricated using mold release in the centrifuge, it is recommended that the cleaning blade edge be on the air side and not the mold side. Although it is possible to use the"mold side" for cleaning, it is not recommended that the present cleaning blade be used on the "mold side" because of its reduced reliability (CSE's do occasionally use the mold side). One method of attaining four cleaning edges that are all from the air sides is to bond two separate blade bodies together on their mold sides, leaving only their air sides exposed on the top and bottom surface of the composite blade body. The overall thickness of the two laminated blades would be equivalent to the thickness of a conventional cleaning blade.

Cleaning blades made from various silicone materials are also being considered. Silicone blades are made without mold release which is believed to be a chief cause of the "mold side" unreliability problem.

In recapitulation, it is evident that the cleaning blade holder of the present invention includes a blade holder that is rotatable 180 degrees, between two positions, to allow four different cleaning edges from the same blade body to be used to clean the imaging surface before the cleaning blade must be replaced. In addition, the cleaner blade body was modified to reduce the time required to install a new blade and to prevent uneven wear on the blade due to improper alignment upon installation. Two blade modifications were discussed above, wherein the better blade modification consists of a rib molded or laminated perpendicular to the lateral plane of the back surface of the blade body. The rib is used as a guide to easily align the blade body into a corresponding groove in the bottom component of the blade holder for an even cleaning edge. The rib also secures the blade body in place as the top component of the blade holder is clamped in place, allowing the cleaning blade edges to laterally extend from opposite sides of the blade holder. The alternate blade modification consists of a series of apertures in the blade body through which nodules on the top surface of the blade holder's bottom component are inserted. The top component of the blade holder contains the mating indentions to the nodules, on the bottom component, to secure the blade body in place when the top and bottom components are clamped together. The four cleaning blade edges are similarly exposed as in the ribbed blade configuration discussed above.

It is therefore, apparent that there has been provided in accordance with the present invention, a 180 degree cleaning blade holder that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning particles from an imaging surface adapted to rotate about an axis of rotation, comprising:

a cleaning blade having at least two cleaning edges with each cleaning edge being spaced from one another; and means for holding said cleaning blades, said holding means being rotatable, about an axis substantially parallel to the axis of rotation of the imaging surface, to position one of the cleaning edges in contact with the imaging surface.

2. An apparatus for cleaning particles from an imaging surface, comprising:

means for cleaning particles from the imaging surface, said cleaning means comprises a blade having four cleaning edges with each cleaning edge being spaced from one another; and means for holding said cleaning means, said holding means being adapted to rotate so as to position one of the cleaning edges in contact with the imaging surface, with the other of said edges being remote therefrom.

3. An apparatus as recited in claim 2, wherein said holding means rotates about 180 degrees to position another one of the cleaning edges in contact with the imaging surface.

4. An apparatus as recited in claim 2, wherein said holding means holds said blades so that the cleaning edge contacting the imaging surface forms a frictional line contact.

5. An apparatus as recited in claim 4, wherein the cleaning edge contacting the imaging surface forms a cleaning angle with the imaging surface.

6. An apparatus as recited in claim 5, wherein the cleaning angle formed by the cleaning edge contacting the imaging surface ranges from about 15 degrees to about 25 degrees.

* * * * *